US010381140B2

(12) United States Patent
Diao et al.

(10) Patent No.: US 10,381,140 B2
(45) Date of Patent: Aug. 13, 2019

(54) PREPARATION OF RARE EARTH PERMANENT MAGNET MATERIAL

(71) Applicant: Tianhe (Baotou) Advanced Tech Magnet Co., Ltd., Baotou (CN)

(72) Inventors: Shulin Diao, Baotou (CN); Yi Dong, Baotou (CN); Haibo Yi, Baotou (CN); Yuelin Fan, Baotou (CN); Juchang Miao, Baotou (CN); Shujie Wu, Baotou (CN); Yi Yuan, Baotou (CN); Ya Chen, Baotou (CN); Wenjie Yuan, Baotou (CN)

(73) Assignee: Tianhe (Baotou) Advanced Tech Magnet Co., Ltd. (CN)

( * ) Notice: Subject to any disclaimer, the term of this patent is extended or adjusted under 35 U.S.C. 154(b) by 628 days.

(21) Appl. No.: 15/060,104

(22) Filed: Mar. 3, 2016

(65) Prior Publication Data

US 2017/0062104 A1 Mar. 2, 2017

(30) Foreign Application Priority Data

Aug. 28, 2015 (CN) ..... 2015 1 0546134

(51) Int. Cl.
*F01D 5/28* (2006.01)
*H01F 1/055* (2006.01)
(Continued)

(52) U.S. Cl.
CPC ..... *H01F 1/055* (2013.01); *B22F 3/24* (2013.01); *B22F 9/023* (2013.01); *B22F 9/04* (2013.01);
(Continued)

(58) Field of Classification Search
CPC ..... H01F 1/055; H01F 1/0536; H01F 1/0577; H01F 41/0293; B22F 9/023; B22F 3/24;
(Continued)

(56) References Cited

U.S. PATENT DOCUMENTS 6,022,424 A * 2/2000 Sellers ..... C22C 1/0441 148/101
2011/0150691 A1* 6/2011 Nakamura ..... B22F 9/023 419/13

FOREIGN PATENT DOCUMENTS

CN 1360318 A * 7/2002
CN 1898757 A 1/2007
(Continued)

OTHER PUBLICATIONS

Steel Heat Treatment Handbook, Marcel Dekker Inc. Chapter 7, p. 483-489 (Year: 1997).*
Machine translation of CN1360318A (Year: 2002).*

*Primary Examiner* — Haytham Soliman
(74) *Attorney, Agent, or Firm* — Lerner, David, Littenberg, Krumholz & Mentlik, LLP

(57) ABSTRACT

The present invention provides a method for preparing a rare earth permanent magnet material. The preparation method of the present invention comprises atomizing spray process and infiltrating process, wherein the atomizing-sprayed sintered rare earth magnet is placed in a closed container before infiltrating. Through the atomizing spray process a solution containing a heavy rare earth element is coated on the surface of a sintered R1-Fe(Co)—B-A-X-M rare earth magnet, and after baking, heat treatment is performed to infiltrate the sprayed heavy rare earth element to the grain boundary phase of the sintered rare earth magnet. This method decreases the amount of a heavy rare earth element used, increases the coercive force of magnets with a little decrease of remanence, decreases the remanence temperature coefficient and coercive force temperature coefficient of the magnet, and improves resistance of the magnet against demagnetization at a high temperature.

9 Claims, 1 Drawing Sheet

(51) Int. Cl.

| | |
|---|---|
| ***H01F 1/057*** | (2006.01) |
| ***H01F 41/02*** | (2006.01) |
| ***B22F 3/24*** | (2006.01) |
| ***B22F 9/02*** | (2006.01) |
| ***B22F 9/04*** | (2006.01) |
| ***H01F 1/053*** | (2006.01) |

(52) U.S. Cl.
CPC ..... *H01F 1/0536* (2013.01); *H01F 1/0577* (2013.01); *H01F 41/0293* (2013.01); *B22F 2003/248* (2013.01); *B22F 2009/044* (2013.01)

(58) Field of Classification Search
CPC . B22F 9/04; B22F 2009/044; B22F 2003/248
See application file for complete search history.

(56) References Cited

FOREIGN PATENT DOCUMENTS

| | | | |
|---|---|---|---|
| CN | 101707107 | A | 5/2010 |
| CN | 101845637 | A | 9/2010 |
| CN | 102181820 | A | 9/2011 |
| CN | 104134528 | A | 11/2014 |

* cited by examiner

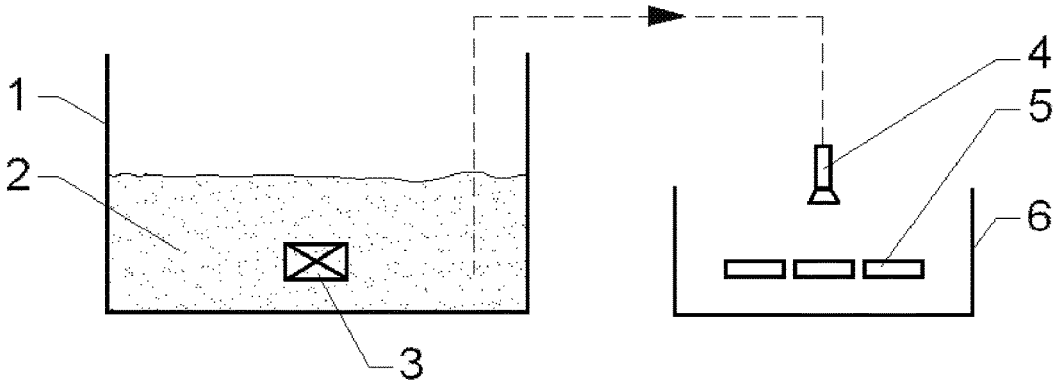
1
2
3
4
5
6

PREPARATION OF RARE EARTH PERMANENT MAGNET MATERIAL

CROSS REFERENCE TO RELATED APPLICATIONS

The present application claims priority from Chinese Patent Application No. 201510546134.8, filed Aug. 28, 2015, the disclosure of which is incorporated herein by reference.

TECHNICAL FIELD OF THE INVENTION

This invention relates to a method for preparing a rare earth permanent magnet material, in particular to a method for preparing a sintered R1-Fe(Co)—B-A-X-M based rare earth permanent magnet.

BACKGROUND OF THE INVENTION

R1-Fe(Co)—B-A-X-M based rare earth sintered magnets with $Nd_2Fe_{14}B$ type compound as a main phase are widely applied to various fields of electronics, automobile, computer, energy, machinery, medical apparatus and the like. When the sintered magnets are used in various devices, such as electric machinery, in order to adapt to the service conditions at a high temperature, it is required that the magnets have a good temperature tolerance and a low temperature coefficient, and the magnets should have low decay amplitudes of remanence and coercive force at a high temperature. In a conventional process, presently, heavy rare earth metals are added during smelt to increase the coercive force of magnets. However, the replacement of medium and heavy rare earth metals happens not only near the interface of main phase grains, but also inside the grains, thereby leading to an unavoidable loss of remanence. Moreover, in order to achieve the same performance, more medium and heavy rare earth metals are required in a conventional process. With respect to the scarcity of the medium and heavy rare earth resources and their increasing prices, new requirements are proposed that the coercive force can be significantly increased while the remanence decrease of the R1-Fe(Co)—B-A-X-M based permanent magnet material can be efficiently inhibited, and the cost of raw materials can be dramatically decreased. In addition, in order to improve the temperature characteristics of R1-Fe(Co)—B-A-X-M based rare earth sintered magnets so that the decay amplitude of a coercive force is smaller at a high temperature, the decay amplitude of a coercive force of the magnets at a high temperature can be well decreased by infiltrating Terbium (Tb), Dysprosium (Dy), Holmium (Ho) and Gadolinium (Gd) into the grain boundary phase of the magnets.

In accordance to above reasons, there is a need to develop a novel process which can decrease the usage of medium and heavy rare earth metals to save the cost of raw materials while improve a temperature coefficient of magnets, so that to accommodate the special requirement that the magnets used for electric motor for new energy vehicles should be sufficiently resistant against demagnetization, and to accommodate the current situation that the price of raw materials increases, particularly, the medium and heavy rare earth metals are scarce, and to overcome the defect of conventional processes that increasing the coercive force of magnets, only by adding medium and heavy rare earth metals, to satisfy the requirement to temperature tolerance of the magnets.

CN101845637A discloses a processing technology of modifying sintered neodymium-iron-boron magnet alloy, which is as follows: solving a powder of heavy rare earth oxide or fluoride into an acid solvent, soaking the magnet, taking out and drying the magnet, and placing the magnet in an argon furnace to carry out thermal diffusion treatment and then carry out annealing treatment. CN102181820A discloses a method for enhancing the coercive force of a neodymium-iron-boron magnet material, which comprises the following steps: firstly, preparing a mixed liquid of rare earth fluoride powder and absolute alcohol; secondly, coating the mixed liquor on the surface of the neodymium-iron-boron material; thirdly, placing the neodymium-iron-boron material, of which the surface is coated with the mixed liquid, in a vacuum heating furnace, and carrying out permeation treatment; and finally, tempering. The above methods still cannot well increase coercive force of magnets, and the waste of raw materials is serious.

CN104134528A discloses a method for improving the magnetic property of sintered neodymium-iron-boron flaky magnets which is: first, suspension liquid containing heavy rare earth elements and having the viscosity of 0.1 to 500 mPa·s at normal temperature and pressure is sprayed onto the surface of a sintered neodymium-iron-boron flaky magnet uniformly; second, the sintered neodymium-iron-boron flaky magnet is dried, and then a coating containing heavy rare earth elements is obtained on the surface of the sintered neodymium-iron-boron flaky magnet; finally, the diffusion treatment and the aging treatment are carried out on the dried neodymium-iron-boron flaky magnet in the environment of inert gas. CN1898757A discloses a method for producing rare earth permanent magnet material, in which a powder comprising one or more components selected from an oxide of R2, a fluoride of R3, and an oxyfluoride of R4 is present in a magnet-surrounding space within a distance of 1 mm from the surface of the magnet. However, the above documents do not disclose or imply that atomizing the mixture solution containing medium and heavy rare earth elements before being sprayed on the surface of the magnet, and thus, the medium and heavy rare earth cannot sufficiently utilized.

CN101707107A discloses a method for producing rare earth permanent magnet material with high remanence and high coercive force, in which burying a magnet in the mixed powder to carry out the infiltration. However, the infiltration effect of this producing method is relatively bad, and the waste of medium and heavy rare earth compound is serious.

SUMMARY OF THE INVENTION

An objective of this invention is to provide a method for preparing a rare earth permanent magnet material which can dramatically decrease the amount of heavy rare earth elements, and save the production cost. A further objective of this invention is to provide a method for preparing a rare earth permanent magnet material which can dramatically decrease a temperature coefficient of magnets.

This invention provides a method for preparing a rare earth permanent magnet material, comprising steps as follows:

S2) atomizing spray step: atomizing a solution containing an element of R2, spraying the atomized solution containing the element of R2 on the sintered rare earth magnet, and baking the sintered rare earth magnet after spraying; and S3) infiltrating step: heat treating the sintered rare earth magnet obtained from the atomizing spray step S2);

wherein the sintered rare earth magnet is R1-Fe(Co)—B-A-X-M based rare earth magnet, wherein R1 is one or more elements selected from Nd, Pr, La, Ce, Tb, Dy, Ho, Er, Eu, Sm, Gd, Pm, Tm, Yb, Lu, Y and Sc;

B represents Boron element;

A is one or more elements selected from H, Li, Na, K, Be, Sr, Ba, Ag, Zn, N, F, Se, Te, Pb and Ga;

X is one or more elements selected from S, C, P and Cu;

M is one or more elements selected from Ti, Ni, Bi, V, Nb, Ta, Cr, Mo, W, Mn, Al, Sb, Ge, Sn, Zr, Hf and Si;

R2 is one or more elements selected from Tb, Dy, Ho and Gd;

wherein the sintered rare earth magnet obtained from the atomizing spray step S2) is placed in a closed container before carrying out the infiltrating step S3).

In accordance to the preparation method of the present invention, in the atomizing spray step S2), the solution containing element of R2 is preferably formed by dispersing a R2 element-containing substance in an organic solvent with 0.3-0.8 g of R2 element-containing substance per milliliter of organic solvent.

In accordance to the preparation method of the present invention, in the atomizing spray step S2), the R2 element-containing substance is preferably at least one selected from a fluoride, an oxide and an oxyfluoride of the R2 element.

In accordance to the preparation method of the present invention, in the atomizing spray step S2), the average particle size of the R2 element-containing substance is preferably smaller than 3 μm.

In accordance to the preparation method of the present invention, in the atomizing spray step S2), the organic solvent is preferably at least one selected from aliphatic hydrocarbons, alicyclic hydrocarbons, alcohols and ketones.

In accordance to the preparation method of the present invention, preferably, in the atomizing spray step S2), the baking temperature is 50-200° C.; the baking time is 0.5-5 hours.

In accordance to the preparation method of the present invention, preferably, in the infiltrating step S3), the heat treating temperature is 600-1200° C.; the vacuum degree is less than or equals to 0.01 Pa.

In accordance to the preparation method of the present invention, preferably, the preparation method further comprises the following steps:

S1) magnet preparation step: preparing the sintered rare earth magnet in the atomizing spray step S2); and S4) aging treatment step: aging treatment is carried out on the sintered rare earth magnet obtained from the infiltrating step S3).

In accordance to the preparation method of the present invention, preferably, the aging treatment is not carried out in the magnet preparation step S1).

In accordance to the preparation method of the present invention, preferably, the magnet preparation step S1) comprises steps as follows:

S1-1) smelting step: smelting a raw rare earth magnet material so that the smelted raw rare earth magnet material forms a master alloy;

S1-2) powdering step: crushing the master alloy from the smelting step S1-1) into magnetic powder;

S1-3) shaping step: pressing the magnetic powder obtained from the powdering step S1-2) into a green body for sintering under the actions of an alignment magnetic field; and S1-4) sintering step: sintering the green body obtained from the shaping step S1-3) into a sintered rare earth magnet.

In the present invention, the rare earth permanent magnet material is obtained through the following steps: atomizing spraying the solution containing heavy rare earth element onto the sintered rare earth magnet surface, placing the sintered rare earth magnet in a closed container before infiltrating, baking and then heat treating the sintered rare earth magnet so that the sprayed heavy rare earth element infiltrates to the grain boundary phase of the sintered rare earth magnet, and aging treating the sintered rare earth magnet. The preparation method of the present invention in which atomizing spraying the heavy rare earth element and/or infiltrating the heavy rare earth element in a closed container is utilized saves the amount of the heavy rare earth element, decreases the cost, and increases the performance-cost ratio of magnets. In accordance to the preferred technical solution of the present invention, the preparation method of the present invention can dramatically increase the coercive force of magnets with a little decrease of remanence. In accordance to the preferred technical solution of the present invention, the coercive force of magnets can be dramatically increased while the remanence being decreased a little. In addition, the preparation method of the present invention can apparently decrease the remanence temperature coefficient and the coercive force temperature coefficient of the magnet, and apparently improve its resistance against demagnetization at a high temperature.

BRIEF DESCRIPTION OF THE DRAWINGS

FIG. 1 is schematic illustration of working mechanism of atomizing spray device according to the present invention.

In the FIGURE, 1 is solution tank, 2 is solution containing R2 element, 3 is ultrasonic vibrator, 4 is atomizing nozzle, 5 is sintered rare earth magnet, and 6 is recovery tank.

DETAILED DESCRIPTION OF EMBODIMENTS

The present invention will be further explained in combination with the following specific embodiments, but the protection scope of the invention is not limited thereto.

The "temperature coefficient" in this invention comprises a remanence temperature coefficient and a coercive force temperature coefficient. In the range where the magnet is permitted to work, the percentage of the remanent magnetic induction change with the environmental temperature change of per 1° C. is designated as a remanence temperature coefficient, and the percentage of the coercive force change with the environmental temperature change of per 1° C. is designated as a coercive force temperature coefficient.

The "remanence" in this invention refers to the value of the magnetic flux density at the point on the saturant magnetic hysteresis loop where the magnetic field strength is zero, and is commonly referred to as $B_r$ or $M_r$, with the unit of Tesla (T) or Gauss (Gs).

The "intrinsic coercive force" in this invention refers to the magnetic field strength when the magnetic field is monotonically decreased to zero from the saturant magnetization state and reversely increased to make its magnetization strength decrease to zero along the saturant magnetic hysteresis loop, and is commonly referred to as $H_{cj}$ or ${}_MH_c$, with the unit of Oersted (Oe).

The "magnetic energy product" in this invention refers to the product of the magnetic flux density (B) of any point on the demagnetization curve and the corresponding magnetic field strength (H), and is commonly referred to as BH. The maximum value of BH is referred to as "maximum magnetic energy product" which is commonly referred to as $(BH)_{max}$, with the unit of Gauss•Oersted (GOe).

The "heavy rare earth element" in this invention is also referred to as "Yttrium element" comprising nine elements of Yttrium (Y), Gadolinium (Gd), Terbium (Tb), Dysprosium (Dy), Holmium (Ho), Erbium (Er), Thulium (Tm), Ytterbium (Yb), Lutetium (Lu) and so on.

The "inert atmosphere" in this invention is referred to the atmosphere which does not react with rare earth magnets and not affect its magnetism. In the present invention, the "inert atmosphere" comprises the atmosphere formed by nitrogen or inert gases (helium, neon, argon, krypton, xenon).

The "vacuum" in this invention means absolute vacuum degree is less than or equal to 0.1 Pa, preferably, is less than or equal to 0.01 Pa, more preferably, is less than or equal to 0.001 Pa. In the present invention, a smaller value of absolute vacuum degree represents a higher vacuum degree.

The "average particle size" is referred to particle size D50; it represents the equivalent diameter of the largest particles when the cumulative distribution in the particle size distribution curve is 50%.

The preparation method of the present invention comprises atomizing spray step S2) and infiltrating step S3). Preferably, the preparation method of the present invention also comprises magnet preparation step S1) and aging treatment step S4).

<Magnet Preparation Step S1)>

The preparation method of the present invention preferably comprises magnet preparation step S1): preparing the sintered rare earth magnet in the atomizing spray step S2). The sintered rare earth magnet of the present invention is R1-Fe(Co)—B-A-X-M based rare earth magnet. In the present invention, Fe(Co) represents the magnet comprises Fe, and may or may not comprise Co. That is, R1-Fe(Co)—B-A-X-M based rare earth magnet represents R1-Fe—B-A-X-M based rare earth magnet or R1-Fe—Co—B-A-X-M based rare earth magnet.

In the present invention, R1 is one or more elements selected from Nd, Pr, La, Ce, Tb, Dy, Ho, Er, Eu, Sm, Gd, Pm, Tm, Yb, Lu, Y and Sc; preferably is one or more elements of Nd, Pr, La, Ce, Tb, Dy, Y and Sc; more preferably is Nd and Dy.

In the present invention, B represents element of Boron. In the present invention, A is one or more elements selected from H, Li, Na, K, Be, Sr, Ba, Ag, Zn, N, F, Se, Te, Pb and Ga; preferably is one or more elements of Na, K, Pb and Ga; more preferably is Ga.

In the present invention, X is one or more elements selected from S, C, P and Cu; preferably C or Cu, more preferably Cu.

In the present invention, M is one or more elements selected from Ti, Ni, Bi, V, Nb, Ta, Cr, Mo, W, Mn, Al, Sb, Ge, Sn, Zr, Hf and Si; preferably is one or more elements of Ti, Ni, Bi, V, Nb, Ta, Cr, Mo, W, Mn, Al and Si; more preferably is Al.

In the present invention, the magnet preparation step S1) preferably comprises steps as follows:

S1-1) smelting step: smelting the raw rare earth magnet material so that the smelted raw rare earth magnet material forms a master alloy;

S1-2) powdering step: crushing the master alloy from the smelting step S1-1) into magnetic powder;

S1-3) shaping step: pressing the magnetic powder obtained from the powdering step S1-2) into a green body for sintering under the actions of an alignment magnetic field; and S1-4) sintering step: sintering to shape the green body obtained from the shaping step S1-3) into a sintered rare earth magnet.

In accordance to the preferred embodiments of the present invention, the magnet preparation step S1) may also comprise the following step:

S1-5) cutting step: cutting the sintered rare earth magnet.

Smelting Step S1-1)

In order to prevent the oxidation of the neodymium-iron-boron magnet raw material and the master alloy prepared therefrom, the smelting step S1-1) of the present invention is preferably carried out in vacuum or inert atmosphere. In the smelting step S1-1), there is no particular limit on rare earth magnet raw material or the ratio thereof, and those raw materials and the ratio thereof which are well known in this field may be adopted. In the smelting step S1-1), the smelting process preferably utilizes an ingot casting process or a strip casting process. The ingot casting process is that cooling and solidifying the smelted neodymium-iron-boron magnet raw material and producing an alloy ingot (master alloy). The strip casting process is that rapidly cooling and solidifying the smelted neodymium-iron-boron magnet raw material and spinning into alloy sheet (master alloy). In accordance to one preferred embodiment of the present invention, the smelting process utilizes a strip casting process. The strip casting process of the present invention may be carried out in a vacuum intermediate frequency induction furnace. The smelting temperature may be 1100-1600° C., preferably 1450-1500° C. The thickness of the alloy sheet (master alloy) of the present invention may be 0.01-5 mm, preferably 0.1-1 mm, more preferably 0.25-0.35 mm; the oxygen content is no more than 2000 ppm, preferably no more than 1500 ppm, and more preferably no more than 1200 ppm. In accordance to one specific embodiment of the present invention, the raw material is put in a vacuum intermediate frequency induction furnace, and argon (Ar) is charged to provide protection and carry out heat melting under the condition that the furnace is vacuumed to below 1 Pa, and the neodymium-iron-boron alloy liquid is poured onto rotating cooling copper rolls after refining, the alloy sheet (master alloy) is prepared with a thickness of 0.25-0.35 mm; the alloy liquid temperature is controlled between 1450-1500° C.

Powdering Step S1-2)

The present invention utilizes the powdering process S1-2) to prepare powder. In order to prevent the oxidation of the master alloy and the magnetic powder crushed therefrom, the powdering step S1-2) of the present invention is preferably carried out in vacuum or inert atmosphere. The powdering process S1-2) of the present invention preferably comprises the following steps:

S1-2-1) coarsely crushing step: crushing the master alloy into coarse magnetic powder with a larger particle size; and S1-2-2) milling step: milling the coarse magnetic powder obtained from coarsely crushing step S1-2-1) into fine magnetic powder.

In the present invention, the average particle size of the coarse magnetic powder obtained from coarsely crushing step S1-2-1) is no more than 500 μm, preferably no more than 300 μm, more preferably no more than 100 μm. In the present invention, the fine magnetic powder obtained from milling step S1-2-2) is no more than 10 μm, preferably no more than 6 μm, more preferably no more than 3-5 μm.

In the coarsely crushing step S1-2-1) of the present invention, a mechanical crushing process and/or a hydrogen decrepitation process is applied to crush the master alloy into coarse magnetic powder. The mechanical crushing process is a process to crush the master alloy into coarse magnetic powder using a mechanical crushing device; the mechanical crushing device may be selected from jaw crusher or hammer crusher. The hydrogen decrepitation process means that firstly making the master alloy absorb hydrogen at a low temperature initializing the master alloy crystal lattice expend through the reaction of master alloy and hydrogen and resulting in that the master alloy crushed into the coarse magnetic powder; then heating the coarse magnetic powder to desorb hydrogen at a high temperature. In accordance to one preferably embodiment of the present invention, the hydrogen decrepitation process of the present invention is preferably carried out in a hydrogen decrepitation furnace. In the hydrogen decrepitation process of the present invention, hydrogen absorption temperature is 20° C.-400° C., preferably 100° C.-300° C., and the hydrogen absorption pressure is 50-600 kPa, preferably 100-500 kPa, and the hydrogen desorption temperature is 400-850° C., preferably 500-700° C.

In the milling step S1-2-2) of the present invention, a ball milling process and/or a jet milling process is applied to crush the coarse magnetic powder into fine magnetic powder. The ball milling process is a process to crush the coarse magnetic powder into fine magnetic powder using a mechanical ball milling device. The mechanical ball milling device may be selected from rolling ball milling, vibration ball milling or high energy ball milling. The jet milling process is a process to make the coarse magnetic powder accelerated and hit each other and then crushed by gas flow. The gas flow may be nitrogen flow, preferably high purity nitrogen flow. The high purity nitrogen flow may have N2 content of no less than 99.0 wt %, preferably no less than 99.9 wt %. The pressure of the gas flow may be 0.1-2.0 MPa, preferably 0.5-1.0 MPa, more preferably 0.6-0.7 MPa.

In accordance to one preferred embodiment of the present invention, the powdering process S1-2) comprises the following steps: firstly, crushing the master alloy into coarse magnetic powder by the hydrogen decrepitation process; and then, crushing the coarse magnetic powder into fine magnetic powder by jet milling process. For example, hydrogenation of alloy sheets is carried out in a hydrogen decrepitation furnace, the alloy sheet turns into loose particles by reactions of low temperature hydrogen absorption and high temperature hydrogen desorption, and powder with an average particle size of 3.0-5.0 m is prepared by a jet milling.

Shaping Step S1-3)

The present invention utilizes the shaping step S1-3) to prepare a green body. In order to prevent oxidation of magnetic powder, the shaping step S1-3) of the present invention is preferably carried out in vacuum or inert atmosphere. In the shaping step S1-3), magnetic powder pressing process is preferably a mould pressing process and/or an isostatic pressing process. The isostatic pressing process of the present invention can be performed in an isostatic presser. The pressure may be 1-100 MPa, preferably 5-50 MPa, more preferably 15-20 MPa. In accordance to one preferred embodiment of the present invention, firstly, the mould pressing process is applied to press the magnetic powder, and then the isostatic pressing process is applied to press the magnetic powder. In the shaping step S1-3) of the present invention, the direction of an alignment magnetic field is aligned parallel or perpendicular to the pressing direction of the magnetic powder. There is no specific limitation on the strength of alignment magnetic field which depends on practical desires. In accordance to the preferred embodiment of the present invention, the strength of alignment magnetic field is at least 1 Tesla (T), preferably at least 1.5 T, more preferably at least 1.8 T. In accordance to the preferred embodiment of the present invention, the shaping step S1-3) of the present invention is as follows: aligning the powder in a magnetic field with the strength of above 1.8 T and pressing the powder into a green body; taking out the green body after demagnetization; vacuuming and sealing; placing the sealed green body in an isostatic presser, and applying a pressure of 15-20 MPa and keeping at the pressure before taking out the green body.

Sintering Step S1-4)

In order to prevent oxidation of the sintered green body, the sintering step S1-4) of the present invention is preferably carried out in vacuum or inert atmosphere. In accordance to the preferred embodiment of the present invention, the sintering step S1-4) is performed in a vacuum sintering furnace. In the present invention, the vacuum degree of the sintering step S1-4) may be below 1.0 Pa, preferably below $5.0\times10^{-1}$ Pa, more preferably below $5.0\times10^{-2}$ Pa. The sintering temperature may be 500-1200° C., preferably 700-1100° C., more preferably 1060-1120° C. In the sintering step S1-4), the sintering time may be 0.5-10 hours, preferably 1-8 hours, more preferably 3-5 hours. In accordance to the preferred embodiment of the present invention, the sintering step S1-4) of the present invention is as follows: placing the shaped green body in a high vacuum furnace to perform sintering; starting to increase the temperature to 750° C. when the vacuum degree is below $5.0\times10^{-2}$ Pa, keeping at this temperature for 3-5 hours; adjusting the sintering temperature to 1060-1120° C., keeping at this temperature for 2-3 hours before charging argon (Ar); cooling the sintered green body to no more than 60° C. so that the master materials is obtained.

Cutting Step S1-5)

In the cutting step S1-5) of the present invention, the cutting process adopts a slicing process and/or a wire cut electrical discharge machining. In the present invention, the sintered rare earth magnet is cut into magnets with a length of 1-100 mm, preferably 2-50 mm. In the present invention, the sintered rare earth magnet is cut into magnets which may have a thickness, in the alignment direction, of 0.1-30 mm, preferably 1-20 mm, more preferably 2-15 mm.

In the present invention, the magnet preparation step S1) is preferably performed before the atomizing spray step S2). To save the cost, no aging treatment is performed in the magnet preparation step S1).

<Atomizing Spray Step S2)>

The preparation method of the present invention comprises atomizing spray step S2): atomizing a solution containing an element of R2, spraying the atomized solution containing the element of R2 on the sintered rare earth magnet, and baking the sintered rare earth magnet after spraying.

In the present invention, the solution containing element of R2 is preferably formed by dispersing a R2 element-containing substance in an organic solvent. Per milliliter of organic solvent comprises 0.3-0.8 g, preferably 0.5-0.6 g of R2 element-containing substance. There is no particular limit to the R2 element-containing substance, only if the substance contains an element of R2 and is able to be dispersed in an organic solvent. Preferably, the substance is at least one of fluoride, oxide and oxyfluoride of R2 element. In the present invention, the R2 element-containing substance has an average particle size of preferably less than 3 μm, more preferably less than 1 μm. The inventor of this application surprisingly found that using a R2 element-containing substance with a small average particle size can make atomizing effects better, the infiltration of R2 element in the rare earth magnet more sufficient, the concentration of R2 element higher, which is more advantageous to improve the rare earth magnet temperature coefficient. In order to obtain a smaller average particle size, an identical process to the milling step S1-2-2) can be applied to mill the R2 element-containing substance. In accordance to one preferred embodiment of the present invention, the jet milling may be applied to mill the R2 element-containing substance. The rotation speed of sorting wheel of the jet milling may be 5000 rpm or more, preferably 7000 rpm or more. In the present invention, there is no particular limitation on the organic solvent, only if it can dissolve the R2 element-containing substance. The organic solvent is preferably at least one of aliphatic hydrocarbons, alicyclic hydrocarbons, alcohols and ketones. Its specific example comprises but not limits to ethanol (alcohol), petrol, ethylene glycol, propylene glycol or glycerin and the like. In the solution containing element of R2, there is no particular limitation on the ratio of the R2 element-containing substance to the organic solvent, which depends on the practical requirements.

The atomizing spray process of the present invention may adopt an air atomizing spray process, an airless atomizing spray process, an air-assisted airless atomizing spray process or an ultrasonic atomizing spray process. In accordance to the preferred embodiment of the present invention, the atomizing spray process adopts the ultrasonic atomizing spray process. In the ultrasonic atomizing spray process of the present invention, the solution containing element of R2 is mixed homogenously in an ultrasonic vibrator and is atomized through a high-speed gas flow device, and is uniformly sprayed on the surface of the sintered rare earth magnet. In accordance to one preferred embodiment of the present invention, the atomizing spray process is performed in an atomizing spray device as shown in FIG. 1. The atomizing spray device of the present invention comprises a solution tank 1, a solution containing element of R2 2, an ultrasonic vibrator 3, an atomizing nozzle 4, a sintered rare earth magnet 5, and a recovery tank 6. It works as follows: the solution containing element of R2 2 stored in the solution tank 1 is mixed homogeneously under the actions of the ultrasonic vibrator 3, and is sprayed on the surface of the sintered rare earth magnet 5 after being atomized through the atomizing nozzle 4, the remaining atomized solution falls into the recovery tank 6.

The baking process of the present invention may adopt those well known in this field, which will be not repeated herein. The baking temperature is preferably 50-200° C., more preferably 100-150° C.; the baking time is preferably 0.5-5 hours, more preferably 1-3 hours. After baking, R2 element-containing substance is homogeneously and compactly attached to the surface of the sintered rare earth magnet.

<Infiltrating Step S3)>

The infiltrating step (i.e., diffusion step) S3) of the present invention is to perform heat treatment to the sintered rare earth magnet obtained from the atomizing spray step S2). The infiltrating step S3) of the present invention is applied to infiltrate the R2 element atomizing-sprayed on the surface of the sintered rare earth magnet to the grain boundary phase in the sintered rare earth magnet. The inventor of this application has surprisingly found that the temperature coefficient of the sintered rare earth magnet can be improved by infiltrating the R2 element to the grain boundary phase of the sintered rare earth magnet.

In accordance to the preferred embodiments of the present invention, the sintered rare earth magnet obtained from the atomizing spray step S2) is placed in a closed container before performing infiltrating step S3). The closed container is preferably made of stainless steel. The inventor of this application has surprisingly found that performing the infiltrating step S3) after placing the atomizing sintered rare earth magnet after spraying in a closed container, the R2 element-containing substance on the surface of the sintered rare earth magnet evaporates through heat treatment, and provides a certain concentration inside the closed container, which is advantageous for the R2 element to infiltrate into the sintered rare earth magnet, and reduces the mass loss of the R2 element due to the evaporation.

In order to prevent the oxidation of the sintered rare earth magnet, the infiltrating step S3) of the present invention is preferably carried out in vacuum or inert atmosphere. In accordance to one preferred embodiments of the present invention, the infiltrating step S3) may be performed in a vacuum infiltrating furnace. The heat treatment temperature of the present invention is preferably lower than the sintering temperature when the sintered rare earth magnet is prepared, and it is preferably 400-1100° C., more preferably 600-1000° C. To remove the oxidation layer on the surface of the sintered rare earth magnet, the infiltrating step S3) of the present invention is firstly kept at the temperature of no more than 1000° C., preferably 700-850° C. for 0.5-5 hours, preferably 1-3 hours; and then kept at the temperature of no more than 1000° C., preferably 900-950° C. for 1-8 hours, preferably 3-5 hours. The absolute vacuum degree of the infiltrating step S3) of the present invention is lower or equal to 0.01 Pa, more preferably lower or equal to 0.001 Pa, most preferably lower or equal to 0.0001 Pa. The inventor of this application has surprisingly found that when heat treatment is performed in the above temperature range, the R2 element-containing substance on the surface of the sintered rare earth magnet evaporates totally under the conditions of vacuum heating; meanwhile, the formed atoms of the R2 element will diffuse to the grain boundary phase in the sintered rare earth magnet through the surface of the sintered rare earth magnet. The heat treatment time of the present invention may be 0.5-10 hours, preferably 2-7 hours.

In accordance to the preferred embodiments of the present invention, the process of heat treatment is as follows: starting to heat till the vacuum degree of the vacuum infiltrating furnace reaches $10^{-5}$ Pa, increasing the temperature to 800° C., keeping at this temperature for 1-1.5 hours; after increasing the temperature to 900-950° C., keeping at this temperature for 3-5 hours. At this temperature, the fluoride, oxide or oxyfluoride of rare earth metal R2 will be totally evaporated under the conditions of high vacuum heating, while the formed rare earth metal atoms will diffuse to the grain boundary phase of magnet through the surface of magnet.

<Aging Treatment Step S4)>

The aging treatment step S4) of the present invention is carried out on the sintered rare earth magnet. To prevent oxidation of the sintered rare earth magnet, the aging treatment step S4) of the present invention is preferably carried out in vacuum or inert atmosphere. In the present invention, the temperature of the aging treatment may be 300-900° C., preferably 400-550° C.; the time of the aging treatment may be 0.5-10 hours, preferably 1-6 hours, and more preferably 4-5 hours.

In accordance to the preferred embodiments of the present invention, aging treatment step S4) is carried out after the infiltrating step S3).

Example 1

The preparation method of rare earth permanent magnet material of example 1 is as follows:

S1) Magnet Preparation Step:

S1-1) smelting step: formulating the raw material with the atomic percents of as follows: 13.8% of Nd, 0.2% of Dy, 0.15% of Cu, 1.2% of Co, 0.3% of Al, 5.85% of B, 0.1% Ga and the balance of Fe; putting the raw material in a vacuum intermediate frequency induction furnace; charging argon (Ar) to protect and carry out heat smelting after the furnace is vacuumed to below 1 Pa; pouring the smelted alloy liquid onto rotating cooling copper rolls so that the alloy sheet is prepared with a thickness of 0.3 mm;

S1-2) powdering step: making the alloy sheets obtained from the smelting step S1-1) to form coarse magnetic powder by low temperature hydrogen absorption and high temperature hydrogen desorption in a hydrogen decrepitation furnace, and then grinding the coarse magnetic powder in the jet milling with nitrogen as media into fine magnetic powder with an average particle size of 4.0 μm;

S1-3) shaping step: aligning the fine magnetic powder obtained from the powdering step S1-2) in a magnetic field with a magnetic field strength of 1.8 T and pressing the powder into a green body; and then taking out the green body after demagnetization; vacuuming and sealing; and then placing the sealed green body in an isostatic presser, and applying a pressure of 15 MPa and keeping at the pressure before taking out the green body;

S1-4) sintered step: placing the green body obtained from the shaping step S1-3) in a high vacuum furnace to perform sintering; starting to increase the temperature to 750° C. when the absolute vacuum degree is below $5.0\times10^{-2}$ Pa, and keeping this temperature for 4.5 hours; adjusting the sintering temperature to 1065° C., and keeping at this temperature for 3 hours; charging argon (Ar) and cooling to obtain the sintered rare earth magnet;

S1-5) cutting process: cutting the sintered rare earth magnet obtained from the sintered step S1-4) into a magnet with 30 mm in length, 10 mm in width, 15 mm in thickness in the direction of orientation;

Take some of the sintered rare earth magnet sample which is obtained from the magnet preparation step S1) but not infiltrated (hereinafter referred to as Comparative sample 1) to perform aging treatment, and then measure its magnetic property and temperature characteristics;

S2) atomizing spray step: placing the sintered rare earth magnet sample obtained from the magnet preparation step S1) but with no aging treatment in an atomizing spray device shown as FIG. 1; after atomizing the solution of anhydrous ethanol and terbium fluoride ($TbF_3$) (0.5 g terbium fluoride per milliliter anhydrous ethanol), spraying the sintered rare earth magnet sample; and then placing the sample in an oven, baking at 130° C. for 2 hours;

S3) infiltrating step: placing the sample obtained from the atomizing spray step S2) in a stainless steel closed container, and placing the stainless steel closed container in a vacuum infiltrating furnace; when the furnace is vacuumed to an absolute vacuum degree below $5.0\times10^{-5}$ Pa, starting to heat the furnace to 800° C. and keeping this temperature for 1.5 hours with the aim to remove the oxidation layer on the surface of the magnet; and then adjusting the temperature to 950° C. and keeping this temperature for 3 hours, wherein terbium fluoride ($TbF_3$) will be totally evaporated and the formed metal atoms of terbium will diffuse to the grain boundary phase of magnet through the surface of magnet at this temperature and absolute vacuum degree; keeping this temperature before charging argon, and cooling to 60° C.;

S4) aging treatment step: performing the aging treatment on the sintered rare earth magnet obtained from the infiltrating step S3) in a high vacuum furnace, wherein the aging treatment temperature is 500° C.; keeping this temperature for 4.5 hours before charging argon, and then cooling to 60° C. and discharging so that the rare earth permanent magnet material of the present invention is obtained.

Magnetic properties and temperature characteristics of the rare earth permanent magnet material obtained from the aging treatment step S4) (hereinafter referred to as Sample 1) are measured.

Example 2

The preparation method of rare earth permanent magnet material of example 2 is as follows:

S1) magnet preparation step: the same as the magnet preparation step S1) of Example 1;

S2) atomizing spray step: placing the sintered rare earth magnet sample obtained from the magnet preparation step S1) but with no aging treatment in an atomizing spray device shown as FIG. 1; after atomizing the solution of anhydrous ethanol and terbium oxide ($TbO_3$) (0.5 g terbium oxide per milliliter anhydrous ethanol), spraying the sintered rare earth magnet sample, and then placing the sample in an oven, baking at 130° C. for 2 hours;

S3) infiltrating step: placing the sample obtained from the atomizing spray step S2) in a stainless steel closed container, and placing the stainless steel closed container in a vacuum infiltrating furnace; when the furnace is vacuumed to an absolute vacuum degree below $5.0\times10^{-5}$ Pa, starting to heat the furnace to 800° C. and keeping this temperature for 1.5 hours with the aim to remove the oxidation layer on the surface of the magnet; and then adjusting the temperature to 950° C. and keeping this temperature for 3 hours, wherein terbium oxide ($TbO_3$) will be totally evaporated and the formed metal atoms of terbium will diffuse to the grain boundary phase of magnet through the surface of magnet at this temperature and absolute vacuum degree; keeping this temperature before charging argon, and cooling to 60° C.;

S4) aging treatment step: performing the aging treatment on the sintered rare earth magnet obtained from the infiltrating step S3) in a high vacuum furnace, wherein the aging treatment temperature is 500° C.; keeping this temperature for 4.5 hours before charging argon, and then cooling to 60° C. and discharging so that the rare earth permanent magnet material of the present invention is obtained.

Magnetic properties and temperature characteristics of the rare earth permanent magnet material obtained from the aging treatment step S4) (hereinafter referred to as Sample 2) are measured.

Example 3

The preparation method of rare earth permanent magnet material of example 3 is as follows:

S1) magnet preparation step: the same as the magnet preparation step S1) of Example 1;

S2) atomizing spray step: placing the sintered rare earth magnet sample obtained from the magnet preparation step S1) but with no aging treatment in an atomizing spray device shown as FIG. 1; after atomizing the solution of petrol and terbium fluoride ($TbF_3$) (0.5 g terbium fluoride per milliliter petrol), spraying the sintered rare earth magnet sample; and then placing the sample in an oven, baking at 130° C. for 2 hours;

S3) infiltrating step: placing the sample obtained from the atomizing spray step S2) in a stainless steel closed container, and placing the stainless steel closed container in a vacuum infiltrating furnace; when the furnace is vacuumed to an absolute vacuum degree below $5.0\times10^{-5}$ Pa, starting to heat the furnace to 800° C. and keeping this temperature for 1.5 hours with the aim to remove the oxidation layer on the surface of the magnet; and then adjusting the temperature to 950° C. and keeping this temperature for 3 hours, wherein terbium fluoride ($TbF_3$) will be totally evaporated and the formed metal atoms of terbium will diffuse to the grain boundary phase of magnet through the surface of magnet at this temperature and absolute vacuum degree; keeping this temperature before charging argon, and cooling to 60° C.;

S4) aging treatment step: performing the aging treatment on the sintered rare earth magnet obtained from the infiltrating step S3) in a high vacuum furnace, wherein the aging treatment temperature is 500° C.; keeping this temperature for 4.5 hours before charging argon, and then cooling to 60° C. and discharging so that the rare earth permanent magnet material of the present invention is obtained.

Magnetic properties and temperature characteristics of the rare earth permanent magnet material obtained from the aging treatment step S4) (hereinafter referred to as Sample 3) are measured.

Example 4

The preparation method of rare earth permanent magnet material of example 4 is as follows:

S1) magnet preparation step: the same as the magnet preparation step S1) of Example 1;

S2) atomizing spray step: placing the sintered rare earth magnet sample obtained from the magnet preparation step S1) but with no aging treatment in an atomizing spray device shown as FIG. 1; after atomizing the solution of petrol and terbium oxide ($TbO_3$) (0.5 g terbium oxide per milliliter petrol), spraying the sintered rare earth magnet sample, and then placing the sample in an oven, baking at 130° C. for 2 hours;

S3) infiltrating step: placing the sample obtained from the atomizing spray step S2) in a stainless steel closed container, and placing the stainless steel closed container in a vacuum infiltrating furnace; when the furnace is vacuumed to an absolute vacuum degree below $5.0\times10^{-5}$ Pa, starting to heat the furnace to 800° C. and keeping this temperature for 1.5 hours with the aim to remove the oxidation layer on the surface of the magnet; and then adjusting the temperature to 950° C. and keeping this temperature for 3 hours, wherein terbium oxide ($TbO_3$) will be totally evaporated, and the formed metal atoms of terbium will diffuse to the grain boundary phase of magnet through the surface of magnet at this temperature and absolute vacuum degree; keeping this temperature before charging argon, and cooling to 60° C.;

S4) aging treatment step: performing the aging treatment on the sintered rare earth magnet obtained from the infiltrating step S3) in a high vacuum furnace, wherein the aging treatment temperature is 500° C.; keeping this temperature for 4.5 hours before charging argon, and then cooling to 60° C. and discharging.

Magnetic properties and temperature characteristics of the rare earth permanent magnet material obtained from the aging treatment step S4) (hereinafter referred to as Sample 4) are measured.

Magnetic properties and temperature characteristics of Comparative sample 1 and Sample 1 to Sample 4 of the present invention are shown in Table 1.

TABLE 1

| No. | Temperature | Remanence (kGs) | Coercive force (kOe) | Remanence temperature coefficient | Coercive force temperature coefficient |
|---|---|---|---|---|---|
| Comparative sample 1 (master batch) | 20° C. | 14.05 | 17.50 | | |
| | 160° C. | 11.54 | 4.10 | −0.127 | −0.546 |
| | 180° C. | 10.92 | 2.90 | −0.139 | −0.521 |
| Sample 1 | 20° C. | 13.83 | 25.90 | | |
| | 160° C. | 11.53 | 9.10 | −0.118 | −0.463 |
| | 180° C. | 11.03 | 7.29 | −0.126 | −0.449 |
| Sample 2 | 20° C. | 13.90 | 26.06 | | |
| | 160° C. | 11.41 | 8.27 | −0.128 | −0.488 |
| | 180° C. | 11.25 | 7.58 | −0.119 | −0.443 |
| Sample 3 | 20° C. | 14.00 | 25.96 | | |
| | 160° C. | 11.53 | 8.34 | −0.126 | −0.485 |
| | 180° C. | 11.32 | 7.55 | −0.120 | −0.443 |
| Sample 4 | 20° C. | 14.05 | 24.9 | | |
| | 160° C. | 11.61 | 7.87 | −0.124 | −0.488 |
| | 180° C. | 11.34 | 7.07 | −0.120 | −0.447 |

It can be seen from the effects of the above examples that the method for preparing rare earth permanent magnet material of the present invention, which infiltrates the heavy rare earth element to the grain boundary phase of the sintered rare earth magnet, in the premise that the remanence decreases a little, increases the coercive force of the magnet at normal temperature with about 7.4-8.56 kOe, largely increases the coercive force of the magnet, and apparently decreases the remanence temperature coefficient and coercive force temperature coefficient of the magnet at 160° C. and 180° C., apparently improves resistance of the magnet against demagnetization at a high temperature. In addition, the method for preparing rare earth permanent magnet material of the present invention adopts atomizing spraying to spray heavy rare earth element, and performs infiltrating in a closed container, which saves 50%-80% of the heavy rare earth element of the conventional process, which is of great significance for decreasing the production cost of rare earth permanent magnet material and increasing the performance-cost ratio of the magnet.

The present invention is not limited by the above embodiments. All variations, modifications and replacements to the disclosed embodiments which are apparent to those skilled in the art and do not depart from the essence of the present invention fall in the scope of the present invention.

What is claimed is:

1. A method for preparing a rare earth permanent magnet material, comprising steps as follows:

S2) atomizing spray step: placing a sintered rare earth magnet in an atomizing spray device, wherein the atomizing spray device comprises a solution tank, an ultrasonic vibrator, an atomizing nozzle, and a recovery tank; storing a solution containing an element of R2 into the solution tank; mixing the solution containing the element of R2 homogeneously by the ultrasonic vibrator; atomizing the solution containing the element of R2; spraying the atomized solution containing the element of R2 on a sintered rare earth magnet through the atomizing nozzle while the remaining atomized solution falls into the recovery tank; and baking the sintered rare earth magnet after spraying; and S3) infiltrating step: placing the sintered rare earth magnet obtained from the atomizing spray step S2) in a stainless steel closed container, placing the stainless steel closed container in a vacuum infiltrating furnace, evacuating the vacuum infiltrating furnace to an absolute vacuum degree of lower or equal to 0.01 Pa, starting to heat the vacuum infiltrating furnace to 700-850° C. and keeping the temperature for 0.5-5 hours with the aim to remove the oxidation layer on a surface of the sintered rare earth magnet; and then adjusting the temperature to 900-950° C. and keeping the temperature for 1-8 hours;

wherein the sintered rare earth magnet is R1-Fe(Co)—B-A-X-M based rare earth magnet, wherein R1 is one or more elements selected from Nd, Pr, La, Ce, Tb, Dy, Ho, Er, Eu, Sm, Gd, Pm, Tm, Yb, Lu, Y or Sc;

B represents Boron element;

A is one or more elements selected from H, Li, Na, K, Be, Sr, Ba, Ag, Zn, N, F, Se, Te, Pb or Ga;

X is one or more elements selected from S, C, P or Cu;

M is one or more elements selected from Ti, Ni, Bi, V, Nb, Ta, Cr, Mo, W, Mn, Al, Sb, Ge, Sn, Zr, Hf or Si; and R2 is one or more elements selected from Tb, Dy, Ho or Gd.

2. The preparation method according to claim 1, characterized in that in the atomizing spray step S2), the solution containing the element of R2 is formed by dispersing a R2 element-containing substance in an organic solvent with 0.3-0.8 g of R2 element-containing substance per milliliter of organic solvent.

3. The preparation method according to claim 2, characterized in that in the atomizing spray step S2), the R2 element-containing substance is at least one selected from a fluoride, an oxide or an oxyfluoride of the R2 element.

4. The preparation method according to claim 2, characterized in that in the atomizing spray step S2), the average particle size of the R2 element-containing substance is smaller than 3 μm.

5. The preparation method according to claim 2, characterized in that in the atomizing spray step S2), the organic solvent is at least one selected from aliphatic hydrocarbons, alicyclic hydrocarbons, alcohols or ketones.

6. The preparation method according to claim 1, characterized in that in the atomizing spray step S2), the baking temperature is 50-200° C.; and the baking time is 0.5-5 hours.

7. A method for preparing a rare earth permanent magnet material, comprising steps as follows:

S1) magnet preparation step: preparing a sintered rare earth magnet;

S2) atomizing spray step: placing the sintered rare earth magnet in an atomizing spray device, wherein the atomizing spray device comprises a solution tank, an ultrasonic vibrator, an atomizing nozzle, and a recovery tank; storing a solution containing an element of R2 into the solution tank; mixing the solution containing the element of R2 homogeneously by the ultrasonic vibrator; atomizing the solution containing the element of R2; spraying the atomized solution containing the element of R2 on the sintered rare earth magnet through the atomizing nozzle while the remaining atomized solution falls into the recovery tank; and baking the sintered rare earth magnet after spraying; and S3) infiltrating step: placing the sintered rare earth magnet obtained from the atomizing spray step S2) in a stainless steel closed container, placing the stainless steel closed container in a vacuum infiltrating furnace, evacuating the vacuum infiltrating furnace to an absolute vacuum degree of lower or equal to 0.01 Pa, starting to heat the vacuum infiltrating furnace to 700-850° C. and keeping the temperature for 0.5-5 hours with the aim to remove the oxidation layer on a surface of the sintered rare earth magnet; and then adjusting the temperature to 900-950° C. and keeping the temperature for 1-8 hours;

wherein the sintered rare earth magnet is R1-Fe(Co)—B-A-X-M based rare earth magnet, wherein R1 is one or more elements selected from Nd, Pr, La, Ce, Tb, Dy, Ho, Er, Eu, Sm, Gd, Pm, Tm, Yb, Lu, Y or Sc;

B represents Boron element;

A is one or more elements selected from H, Li, Na, K, Be, Sr, Ba, Ag, Zn, N, F, Se, Te, Pb or Ga;

X is one or more elements selected from S, C, P or Cu;

M is one or more elements selected from Ti, Ni, Bi, V, Nb, Ta, Cr, Mo, W, Mn, Al, Sb, Ge, Sn, Zr, Hf or Si; and R2 is one or more elements selected from Tb, Dy, Ho or Gd;

S4) aging treatment step: the aging treatment is carried out on the sintered rare earth magnet obtained from the infiltrating step S3).

8. The preparation method according to claim 7, characterized in that the magnet preparation step S1) comprising steps as follows:

S1-1) smelting step: smelting a raw rare earth magnet material so that the smelted raw rare earth magnet material forms a master alloy;

S1-2) powdering step: crushing the master alloy from the smelting step S1-1) into magnetic powder;

S1-3) shaping step: pressing the magnetic powder obtained from the powdering step S1-2) into a green body for sintering under the actions of an alignment magnetic field; and S1-4) sintering step: sintering the green body obtained from the shaping step S1-3) into the sintered rare earth magnet.

9. The preparation method according to claim 7, characterized in that in the aging treatment step S4), the aging treatment temperature is 300-900° C.; and the aging treatment time is 0.5-10 hours.

* * * * *